US007678029B2

(12) United States Patent
Ng

(10) Patent No.: US 7,678,029 B2
(45) Date of Patent: Mar. 16, 2010

(54) INFLATABLE PUNCHING BAG

(76) Inventor: Wai-Jim Ng, Room 12, 1st Florr, Man Lee Industrial Building 13 Kin Hong Street, Kwai Chung, N.T. (HK)

( * ) Notice: Subject to any disclaimer, the term of this patent is extended or adjusted under 35 U.S.C. 154(b) by 154 days.

(21) Appl. No.: 12/145,547

(22) Filed: Jun. 25, 2008

(65) Prior Publication Data

US 2008/0260299 A1 Oct. 23, 2008

Related U.S. Application Data

(63) Continuation-in-part of application No. 11/491,889, filed on Jul. 24, 2006, now abandoned.

(51) Int. Cl.
*A63B 69/22* (2006.01)
*A63B 69/24* (2006.01)

(52) U.S. Cl. ..... 482/90

(58) Field of Classification Search ..... 482/1, 482/8, 83–90; 73/379.01, 379.04; 383/3; 473/442–445; 273/440.1; *A63B 69/20, 69/22, A63B 69/24, 69/26, 69/28, 69/32, 69/34, A63B 21/002*

See application file for complete search history.

(56) References Cited

U.S. PATENT DOCUMENTS

| | | | | |
|---|---|---|---|---|
| 5,330,403 | A * | 7/1994 | Kuo | 482/83 |
| 2007/0087911 | A1 * | 4/2007 | Ghim | 482/84 |
| 2008/0274862 | A1 * | 11/2008 | Wang | 482/87 |

* cited by examiner

*Primary Examiner*—Loan H Thanh
*Assistant Examiner*—Oren Ginsberg
(74) *Attorney, Agent, or Firm*—Donald J. Ersler

(57) ABSTRACT

An inflatable punching bag includes an inflatable bag, at least one sensor device, a control box and a base. At least one impact area is formed on the inflatable bag. A single sensor device is attached behind each impact area. Each sensor device preferably includes a sensor case, at least one light source and an impact sensor. A control box includes a power source, a sound transducer and an electrical circuit. The electrical circuit receives input from at least one impact sensor. The electrical circuit provides a light output through the at least one light source and/or an audible output through the sound transducer. The base preferably includes a weighted portion and intermediate portion. The weighted portion is filled with a dense solid or a liquid to provide support for the inflatable bag. A second embodiment includes a motor for pivoting the inflatable bag.

19 Claims, 4 Drawing Sheets

INFLATABLE PUNCHING BAG

CROSS-REFERENCES TO RELATED APPLICATIONS

This is a continuation-in-part patent application taking priority from nonprovisional application Ser. No. 11/491,889 filed on Jul. 24, 2006 now abandoned.

BACKGROUND OF THE INVENTION

1. Field of the Invention

The present invention relates generally to exercise and more specifically to an inflatable punching bag, which includes a plurality of impact areas that provide feedback when struck.

2. Discussion of the Prior Art

Patent application number 2004/0097347 to Ghim discloses a sports training device. The Ghim application includes a body having at least one hitting surface sized and shaped so as to receive a punch or kick delivered by a user. A sound generator is carried by the body for generating an audible sound and includes a switch carried by the body for causing the generator to generate the sound in response to an impact created by the punch or kick. However, the Ghim device is not inflatable.

Accordingly, there is a clearly felt need in the art for an inflatable punching bag, which may be deflated for transportation in a small enclosure and includes a plurality of impact areas that provide feedback when struck.

SUMMARY OF THE INVENTION

The present invention provides an inflatable punching bag, which includes a plurality of impact areas that provide feedback when struck. The inflatable punching bag preferably includes an inflatable bag, at least one sensor device, a control box and a base. The inflatable bag is preferably fabricated from a PVC plastic material. An air valve is preferably formed on a top of the inflatable bag for filing thereof with air. At least one impact area is formed on a front of the inflatable bag. A single sensor device is formed behind each one of the at least one impact area. The sensor device preferably includes a sensor case, at least one light source and an impact sensor. The wires from each sensor device are run through a rear of the inflatable bag. The wire opening is sealed to prevent the loss of air pressure.

The control box includes a power source, a sound transducer and an electrical circuit. The electrical circuit receives input from the at least one impact sensor. The electrical circuit may be programmed to provide a light output through the at least one light source and/or an audible output through the sound transducer. The base preferably includes a weighted portion and intermediate portion. The weighted portion includes a fill cap. The weighted portion is filled with a dense solid or a liquid to prevent the inflatable bag punching bag from being knocked over during use. The intermediate portion includes an air nozzle for filling thereof with air. A bottom of the intermediate portion is secured to a top of the weighted portion and a top of the intermediate portion is secured to a bottom of the inflatable bag.

A second embodiment of an inflatable punching bag preferably includes an inflatable bag, at least one sensor device, a control box, an electric motor and a base. The second embodiment includes most of the features of the first embodiment of the inflatable punching bag and the electric motor for pivoting the inflatable bag back and forth. A bag bore is formed down a center of the inflatable bag to receive a drive shaft. The drive shaft is substantially the length of the bag bore. The drive shaft is inserted into the bag bore. A motor shaft of the electric motor is coupled to the drive shaft through a coiled spring. One end of the coiled spring is attached to the motor shaft and the other end of the coiled spring is attached to the drive shaft with welding or any other suitable method.

The electric motor receives power from the control box. The electric motor rotates the inflatable bag to a set angle in a clockwise direction and then rotate to a set angle in a counterclockwise direction as powered by the control box. A motor hole is formed through a center of the weighted portion for retention of the electric motor. The intermediate portion is eliminated and replaced with the coiled spring.

Accordingly, it is an object of the present invention to provide an inflatable punching bag, which may be deflated for transportation in a small enclosure.

It is a further object of the present invention to provide an inflatable punching bag, which includes a plurality of impact areas that provide feedback when struck.

Finally, it is another object of the present invention to provide an inflatable punching bag, which includes an electric motor for pivoting the inflatable bag back and forth.

These and additional objects, advantages, features and benefits of the present invention will become apparent from the following specification.

DETAILED DESCRIPTION OF THE PREFERRED EMBODIMENTS

Figure 2:
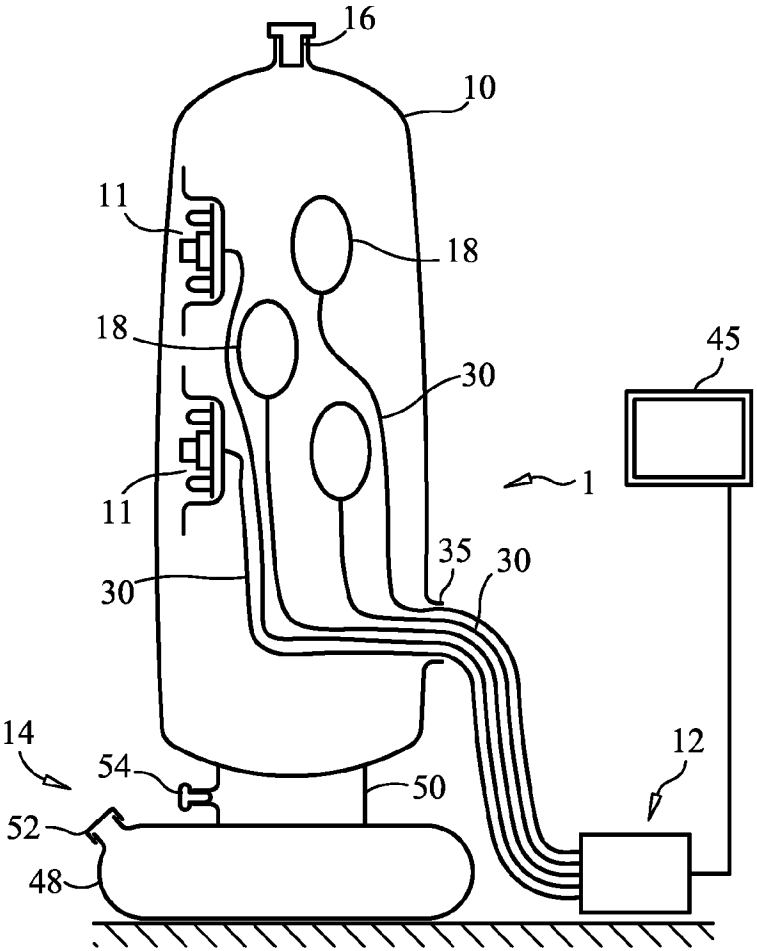
FIG. 2 is a side view of an inflatable punching bag disclosing a side view of two sensor devices in accordance with the present invention.
Figure 1:
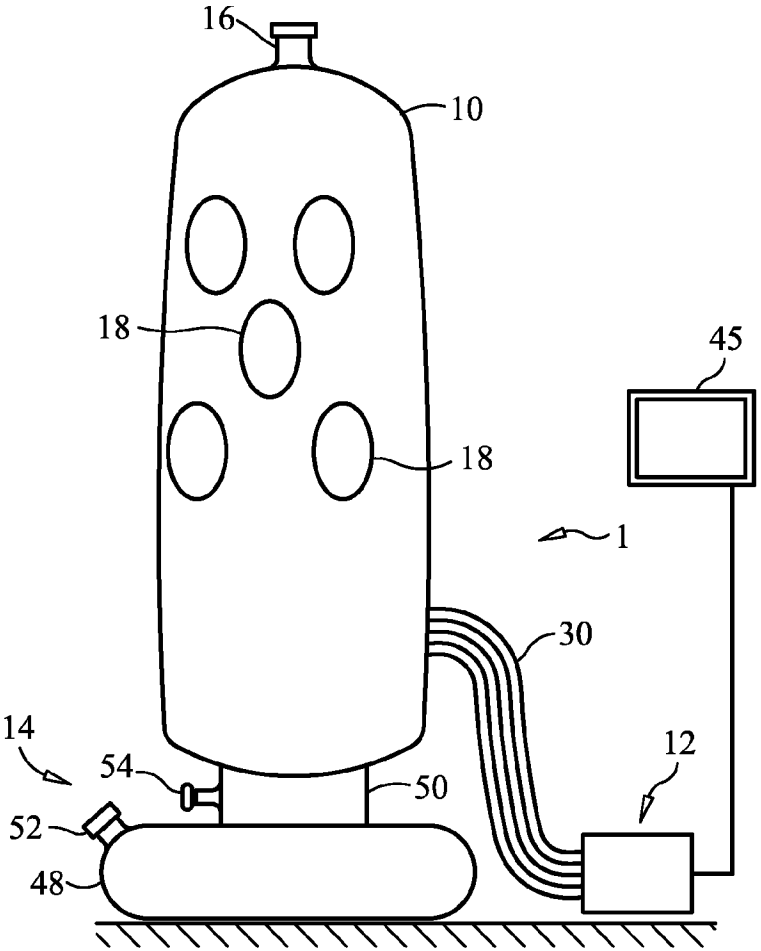
FIG. 1 is a side view of an inflatable punching bag in accordance with the present invention.
Figure 3:
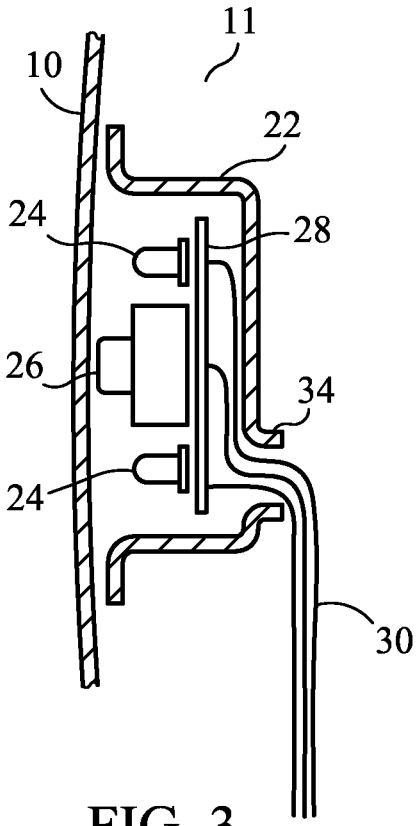
FIG. 3 is an enlarged cross sectional side view of a sensor device of an inflatable punching bag in accordance with the present invention.
Figure 4:
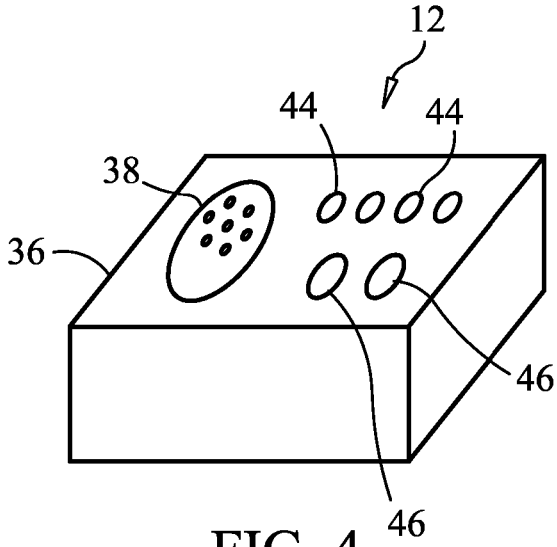
FIG. 4 is a perspective view of a control box of an inflatable punching bag in accordance with the present invention.
Figure 5:
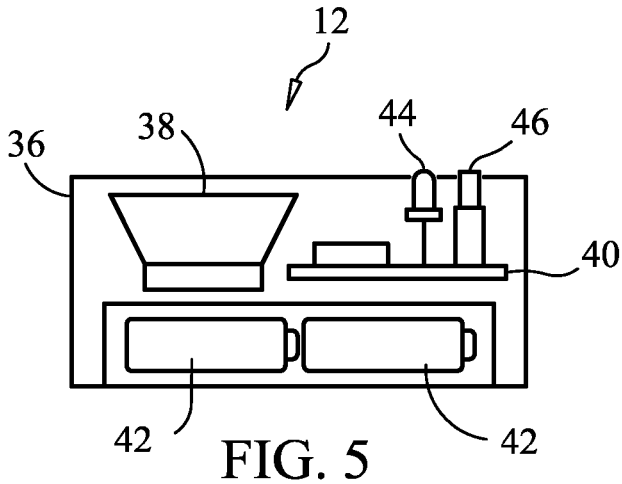
FIG. 5 is a cross sectional view of a control box of an inflatable punching bag in accordance with the present invention.

With reference now to the drawings, and particularly to FIG. 1, there is shown a side view of an inflatable punching bag 1. With reference to FIGS. 2-5, the inflatable punching bag 1 preferably includes an inflatable bag 10, at least one sensor device 11, a control box 12, and a base 14. The inflatable bag 10 is preferably fabricated from a PVC plastic material, but other suitable materials may also be used. An air valve 16 is preferably formed on a top of the inflatable bag for filing thereof with air. At least one impact area 18 is formed on a front of the inflatable bag 10. The at least one impact area 18 may have any suitable shape. A single sensor device 11 is formed behind each one of the at least one impact area 18.

The sensor device 11 preferably includes a sensor case 22, at least one light source 24 and an impact sensor 26. The impact sensor 26 and at least one light source 24 is preferably retained on a circuit board 28. The at least one light source 24 may be a light emitting diode, a light bulb or any other suitable light source. The impact sensor 26 may be a tact switch, a pressure sensor or any other suitable type of sensor. The circuit board 28 is retained in the sensor case 22. A plurality of sensor wires 30 extend from the circuit board 28, through a sensor case opening 34 in a rear of the sensor case 22. A perimeter of the sensor case 22 is attached to an inside wall of the inflatable bag 10 with adhesive or any other suitable attachment method. The sensor wires 30 from the at least one sensor device 11 are run through a wire bundle opening 35 in a rear of the inflatable bag 10. The wire bundle opening 35 is sealed to prevent the loss of air pressure from the inflatable bag 10.

The control box 12 includes a control case 36, a power source, a sound transducer 38 and an electrical circuit 40. The power source may be at least one battery 42, a battery adapter plugged into a wall outlet of a dwelling or any other suitable power source. The power source provides electrical power to the electrical circuit 40. The electrical circuit 40 could be a microprocessor based board, a microcontroller based board or any other suitable electrical circuit board. The electrical circuit 40 receives input from the at least one impact sensor 26. The electrical circuit 40 may be programmed to provide a light output or a video output through the at least one light source 24 and/or an audible output through the sound transducer 38. The electrical circuit 40 may be programmed to provide a light output or a video output through the video display 45. The sound transducer 38 may also be located adjacent each impact sensor 26. A box light source 44 may be powered when one of the impact sensors 26 is actuated. The electrical circuit 40 may also be programmed to power a light, if the impact experienced by the impact sensor 26 is greater than a set amount. At least one button 46 may be used to select a preprogrammed setting in the electrical circuit 40.

The base 14 preferably includes a weighted portion 48 and intermediate portion 50. The weighted portion 48 includes a fill cap 52. The weighted portion 48 is fabricated from a rigid plastic, but other rigid materials may also be used. The weighted portion 48 is filled with a dense solid or a liquid, such as sand or water to provide support to prevent the inflatable bag 1 from being knocked over during use. The intermediate portion 50 includes an air nozzle 54 for filling thereof with air. A bottom of the intermediate portion 50 is secured to a top of the weighted portion 48 and a top of the intermediate portion 50 is secured to a bottom of the inflatable bag 10. The air in the intermediate portion 50 provides flexibility and elasticity for the swinging motion of the inflatable punching bag 1. The inflatable punching bag 1 may be collapsed to a size substantially the same as the weighted portion 48 by deflating the inflatable bag 10 and the intermediate portion 50. The inflatable punching bag 1 may be transported, after emptying the weighted portion 48 of the dense solid or liquid. The inflatable bag 10 and the intermediate portion 50 may be inflated with human breathing or an air pump.

Figure 7:
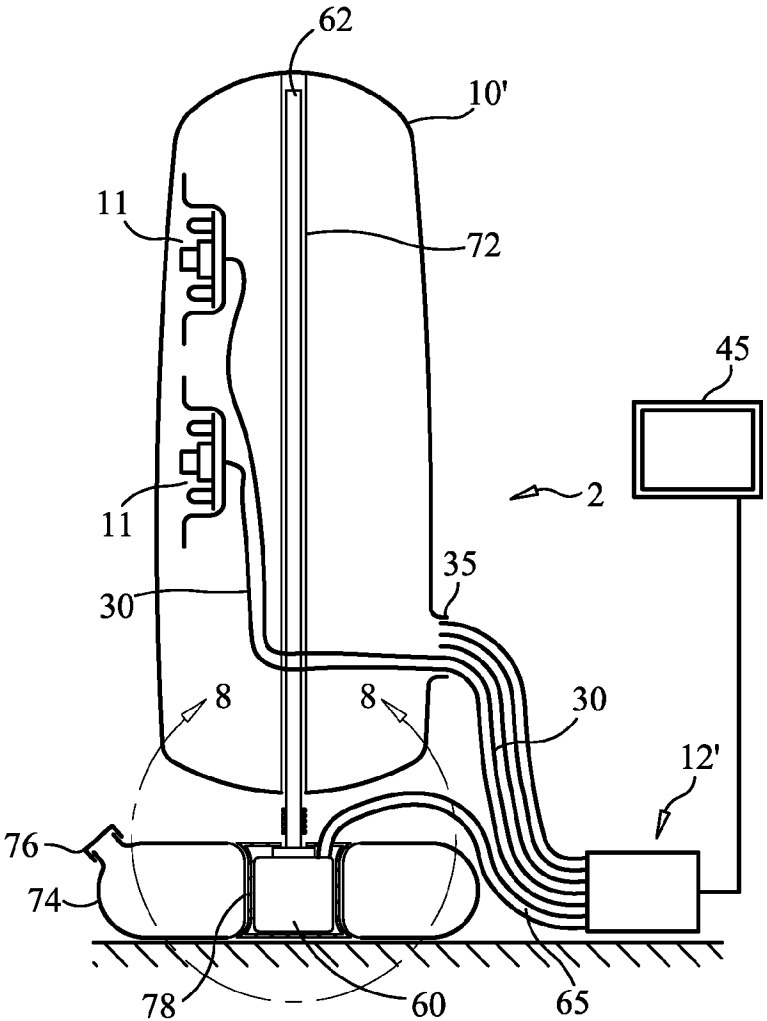
FIG. 7 is a side cross sectional view of an inflatable punching bag in accordance with the present invention.
Figure 6:
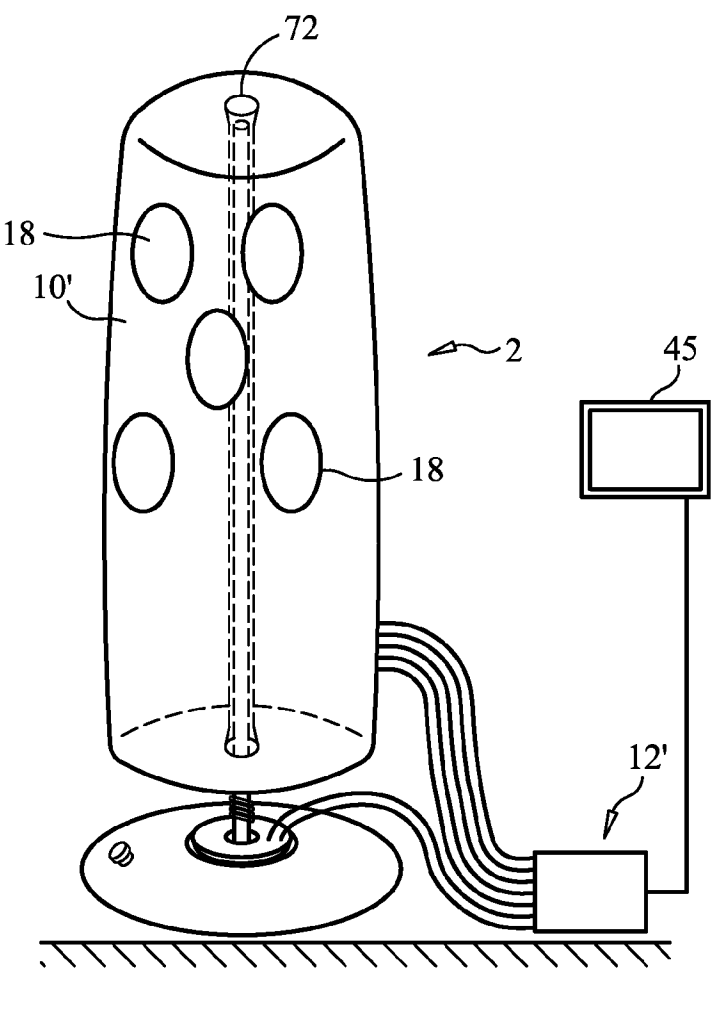
FIG. 6 is a perspective view of a second embodiment of an inflatable punching bag in accordance with the present invention.
Figure 8:
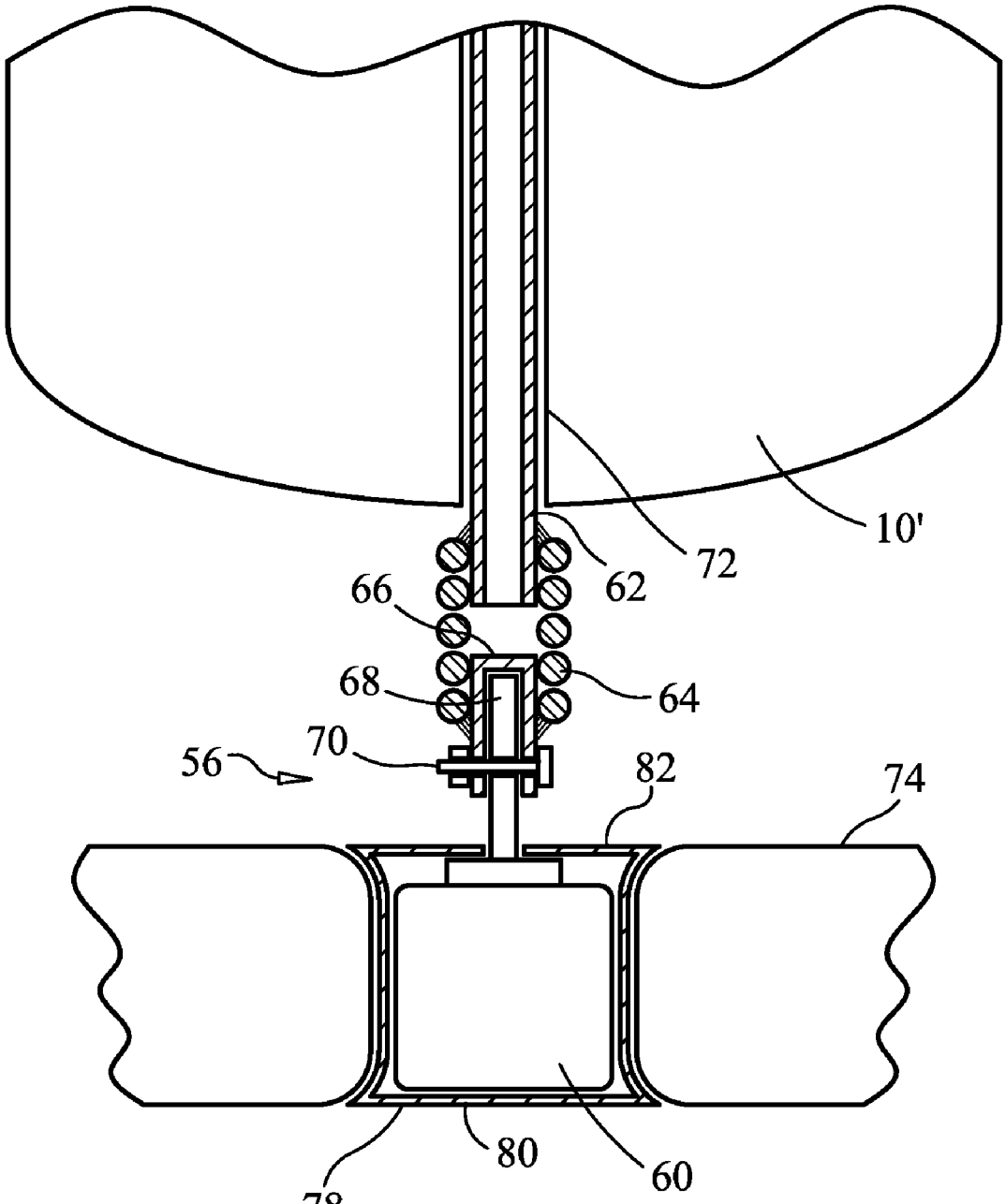
FIG. 8 is an enlarged view of FIG. 7 of an inflatable punching bag in accordance with the present invention.

With reference to FIGS. 6-8, a second embodiment of an inflatable punching bag 2 preferably includes the inflatable bag 10', the at least one sensor device 11, a control box 12' and a drive assembly 56. The inflatable punching bag 2 includes most of the features of the inflatable punching bag 1 and the drive assembly 56 for pivoting the inflatable bag back and forth. The drive assembly 56 includes an electric motor 60, a drive shaft 62, a coiled spring 64 and a shaft cap 66. The electric motor 60 includes a motor shaft 68. The shaft cap 66 is sized to receive the motor shaft 60. A locking pin 70 is preferably inserted through the shaft cap 66 and the motor shaft 60. One end of the coiled spring 64 is preferably attached to the shaft cap 66 with welding or any other suitable method. The other end of the coiled spring 64 is attached to the drive shaft 62 with welding or any other suitable method. The coiled spring 64 must be strong enough to withstand repeated punching while pivoting the inflatable bag 10'. The coiled spring 64 could be a compression or extension spring.

A bag bore 72 is formed down a center of the inflatable bag 10' to receive a drive shaft 62. The drive shaft 62 is substantially the length of the inflatable bag 10'. The drive shaft 62 is inserted into the bag bore 72. The electric motor 60 receives power from the control box 12' through at least one wire 65. The control box 12' includes a circuit for pivoting the inflatable bag 10' to a set angle in a clockwise direction and then pivoting the inflatable bag 10' to a set angle in a counterclockwise direction and repeating the previously described motion. Inflating the inflatable bag 10' provides sufficient frictional engagement between the drive shaft and bag bore 72 for pivoting the inflatable bag 10'. The electrical circuit 40 may be programmed to provide a light output or a video output through the video display 45.

A weighted portion 74 replaces the weighted portion 48. The weighted portion 74 includes a fill cap 76 and a motor cup 78. The weighted portion 74 is fabricated from a rigid plastic, but other rigid materials may also be used. The weighted portion 74 is filled with a dense solid or a liquid, such as sand or water to provide support to prevent the inflatable punching bag 2 from being knocked over during use. The motor cup 78 is preferably molded in substantially a center of the weight portion as an integral part thereof. Each end of the motor cup 78 is preferably terminated with a first flared end 80 and a second flared end 82. The first and second flared ends of the motor cup 78 allow the motor cup 78 to be more securely retained in the weighted portion 74. The electric motor 60 is secured in the motor cup 78 with fasteners or the like. The intermediate portion 50 of the inflatable punching bag 1 is eliminated and replaced with the coiled spring 64.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An inflatable punching bag comprising:

an inflatable bag having means for filling thereof with air, wherein said means for filling thereof with air comprises an air valve, said inflatable bag having at least one impact area formed on a front of said bag for striking;

at least one impact sensor being disposed on an inside wall of said inflatable bag behind each of the at least one impact area, said impact sensor activating at least one of at least one light source and a sound transducer when struck;

a base being attached to a bottom of said inflatable bag, said base providing support for said inflatable bag; and a motor being retained in said base, a motor shaft of said motor supporting said inflatable bag, said motor being powered to pivot said inflatable bag to a set angle in a clockwise direction or a counterclockwise direction.

2. The inflatable punching bag of claim 1, further comprising:

an electrical circuit receiving input from said at least one impact sensor, said electrical circuit activating said at least one of at least one light source and a sound transducer.

3. The inflatable punching bag of claim 1, further comprising:

at least one of said at least one light source being positioned adjacent each one of said at least one impact sensor.

4. The inflatable punching bag of claim 1, further comprising:

a coiled spring having one end engaged with said motor shaft and the other end secured to said inflatable bag.

5. The inflatable punching bag of claim 2, further comprising:

a power source for supplying electrical power to said electrical circuit.

6. The inflatable punching bag of claim 1, further comprising:

said base being filled with a dense material or a liquid.

7. The inflatable punching bag of claim 1, further comprising:

a bag bore being through substantially a center of said inflatable bag.

8. An inflatable punching bag comprising:

an inflatable bag having means for filling thereof with air, wherein said means for filling thereof with air comprises an air valve, said inflatable bag having at least one impact area formed on a front of said bag for striking;

at least one impact sensor being disposed on an inside wall of said inflatable bag behind each of the at least one impact area, said impact sensor activating at least one of at least one light source and a sound transducer when struck;

a base being attached to a bottom of said inflatable bag, said base providing support for said inflatable bag;

a motor being retained in said base, said motor including a motor shaft, said motor being powered to pivot said inflatable bag to a set angle in a clockwise direction or a counterclockwise direction; and a coiled spring having one end engaged with said motor shaft and the other end secured to said inflatable bag.

9. The inflatable punching bag of claim 8, further comprising:

an electrical circuit receiving input from said at least one impact sensor, said electrical circuit activating said at least one of at least one light source and a sound transducer.

10. The inflatable punching bag of claim 8, further comprising:

at least one of said at least one light source being positioned adjacent each one of said at least one impact sensor.

11. The inflatable punching bag of claim 9, further comprising:

a power source for supplying electrical power to said electrical circuit.

12. The inflatable punching bag of claim 8, further comprising:

said base being filled with a dense material or a liquid.

13. The inflatable punching bag of claim 1, further comprising:

a bag bore being through substantially a center of said inflatable bag.

14. The inflatable punching bag of claim 13, further comprising:

a drive shaft extending from the other end of said coiled spring, said drive shaft being inserted into said bag bore.

15. An inflatable punching bag comprising:

an inflatable bag having means for filling thereof with air, wherein said means for filling thereof with air comprises an air valve, said inflatable bag having at least one impact area formed on a front of said bag for striking, a bag bore being formed down substantially a center thereof;

at least one impact sensor being disposed on an inside wall of said inflatable bag behind each of the at least one impact area, said impact sensor activating at least one of at least one light source and a sound transducer when struck;

a base being attached to a bottom of said inflatable bag, said base providing support for said inflatable bag;

a motor being retained in said base, said motor including a motor shaft, said motor being powered to pivot said inflatable bag to a set angle in a clockwise direction or a counterclockwise direction; and a coiled spring having one end engaged with said motor shaft and the other end secured to a drive shaft, said drive shaft being inserted into said bag bore.

16. The inflatable punching bag of claim 15, further comprising:

an electrical circuit receiving input from said at least one impact sensor, said electrical circuit activating said at least one of at least one light source and a sound transducer.

17. The inflatable punching bag of claim 15, further comprising:

at least one of said at least one light source being positioned adjacent each one of said at least one impact sensor.

18. The inflatable punching bag of claim 16, further comprising:

a power source for supplying electrical power to said electrical circuit.

19. The inflatable punching bag of claim 15, further comprising:

said base being filled with a dense material or a liquid.

* * * * *